US006673174B2

(12) United States Patent
Daoud

(10) Patent No.: US 6,673,174 B2
(45) Date of Patent: Jan. 6, 2004

(54) HIGH PERFORMANCE PLASTIC BONDED EXPLOSIVE

(75) Inventor: Sami Daoud, Bedford, NH (US)

(73) Assignee: Textron Systems Corporation, Wilmington, MA (US)

( * ) Notice: Subject to any disclaimer, the term of this patent is extended or adjusted under 35 U.S.C. 154(b) by 0 days.

(21) Appl. No.: 09/929,756

(22) Filed: Aug. 14, 2001

(65) Prior Publication Data

US 2003/0062103 A1 Apr. 3, 2003

(51) Int. Cl.[7] ..... C06B 25/34; C06B 45/10
(52) U.S. Cl. ..... 149/92; 149/19.91
(58) Field of Search ..... 149/19.91, 19.92, 149/92; 264/3.1, 3.3

(56) References Cited

U.S. PATENT DOCUMENTS 3,173,817 A * 3/1965 Wright ..... 149/2
5,487,851 A * 1/1996 Dillehay et al. ..... 264/3.3
5,693,794 A 12/1997 Nielsen
5,712,511 A 1/1998 Chan et al.
6,217,799 B1 * 4/2001 Lee et al. ..... 264/3.3

OTHER PUBLICATIONS

"Engineering Design Handbook: Explosives Series Properties of Explosives of Military Interest," Army Materials Command, National Technical Information Services, U.S. Department of Commerce (Jan., 1971).
Thiokol CL–20 CRADA. "Hexanitrohexaazaisowurtzitane" Jul. 25, 1996.
China Lake Team "Advanced CL–20 Based Propellant Formulated by China Lake Team".

* cited by examiner

*Primary Examiner*—Michael J. Carone
*Assistant Examiner*—Aileen B. Felton
(74) *Attorney, Agent, or Firm*—Mills & Onello, LLP

(57) ABSTRACT

Plastic bonded explosive (PBX) compositions utilizing CL-20 as the oxidizer, and particularly when the CL-20 is blended with particular combinations of binders and/or plasticizers, have been found to yield synergistic chemical combinations which demonstrate higher energy density and increased penetration power and impetus in military weapons and similar applications.

11 Claims, No Drawings

HIGH PERFORMANCE PLASTIC BONDED EXPLOSIVE

FIELD OF THE INVENTION

The present invention relates generally to the field of high performance plastic bonded explosive (PBX) compositions for use in explosive warheads for military weapons systems and comparable applications. The improved PBX compositions of the present invention have been found to demonstrate higher energy density and increased penetration power and impetus while maintaining material safety and handling characteristics comparable to conventional PBX compositions.

BACKGROUND OF THE INVENTION

It is generally known in the art of military explosives to formulate plastic bonded explosive (PBX) compositions consisting of three principal components: (1) an oxidizer; (2) a binder; and, (3) a plasticizer. PBX formulations consisting of an oxidizer and a thermoplastic elastomeric (TPE) binder are also common. Based on their chemical properties, conventional binders are commonly characterized as either "energetic" or "inert". Conventional oxidizers, whether energetic or inert, are termed "oxidizers."

In general, conventional PBX compositions are prepared by adding the two or three ingredients, as solid powders or small particles, and in certain predetermined proportions, to the thermally jacketed container of a heated mixing device while maintaining a temperature inside the jacketed container of about 120° F. to 140° F., and blending the ingredients until the mixture is consistent and homogeneous. The thoroughly blended PBX mix is subsequently pressed and/or extruded into billets of the desired size for packing into warheads.

Two familiar oxidizers which can be used in conventional PBX compositions are: (1) HMX, a type of oxidizer standing for "High-Melting Point Explosive," is also known as Octogen and is chemically known as cyclotetramethylenetetranitramine; and (2) RDX, a type of oxidizer standing for "Royal Demolition Explosive," is also known as Cyclonite or Hexogen, and is chemically known as cyclotrimethylenetrinitramine. Descriptions of the chemical compositions and properties of HMX and RDX can be found in the following publication: "Engineering Design Handbook: Explosives Series Properties of Explosives of Military Interest," Army Materials Command, National Technical Information Services, U.S. Department of Commerce (January, 1971). While HMX has commonly been used in explosive compositions, RDX is more commonly used in propellants.

Some known "energetic" binders used in PBX compositions include nitrocellulose, nitrostarch, polyvinylnitrate, and nitropolyurethanes. Some known inert binders used in PBX compositions include celluloseacetate (CA), celluloseacetate butyrate (CAB), hydroxy-terminated polybutadiene (HTPB), and polyurethanes. Some conventional energetic plasticizers are: BDNPF (Bis-2,2-Dinitropropyl Fumarate); NG (Nitroglycerin); Methyl/Ethyl Nena; Butyl Nena; MTN/DEGDN (Metriol trinitrate/Diethylene Glycol Dinitrate); and DEGDN (Diethylene Glycol Dinitrate). Some conventional inert plasticizers include: TA (Triacetin); DEP (DiethylPhathalate); and DBP (DibutylPhathalate).

Conventional PBX compositions could be improved, however, in several respects. First, a PBX composition demonstrating a higher energy density would be more effective in a warhead on a volume equivalent basis. Second, a PBX composition which, based on its explosive characteristics, provided increased penetration power and impetus would make the warhead in which it was used a more effective weapon. Improved weapons penetration is increasingly important. This improvement is required because increased penetration would enable the military weapons to successfully strike underground enemy installations such as laboratories, airports, and chemical and biological factories. Increasingly, hostile countries, often controlled by dictatorial rulers, are resorting to such underground facilities both to avoid detection by aerial surveillance as well as to secure those facilities against attacks. The only way of disabling such facilities would be an improved warhead penetration capability. At the same time, an improved PBX composition must also demonstrate good material safety, handling and storage characteristics, comparable to or better than the characteristics of conventional PBX compositions.

The improved PBX compositions of the present invention have been found to show surprisingly higher energy density and superior explosive characteristics while equaling or bettering the material safety and handling stability of conventional PBX compositions.

OBJECTS OF THE INVENTION

Accordingly, a general object of this invention is to provide improved high performance plastic bonded explosive (PBX) compositions for use in explosive warheads for military weapons and the like.

Another general object of this invention is to provide improved PBX compositions consisting essentially of an oxidizer, a binder and a plasticizer.

Still another general object of this invention is to provide improved PBX compositions having high energy density and increased penetration power.

Still another general object of this invention is to provide improved PBX compositions while maintaining material safety and handling and storage characteristics at least comparable to conventional PBX compositions.

A specific object of this invention is to provide improved PBX compositions in which the compound identified as CL-20 is the oxidizer.

Another specific object of this invention is to provide improved PBX compositions utilizing CL-20 as the oxidizer in combination with a binder selected from the group consisting of ethylene vinyl acetate and polyisobutylene.

Another specific object of this invention is to provide improved PBX compositions utilizing CL-20 as the oxidizer and triacetin as the plasticizer in combination with a binder selected from the group consisting of ethylene vinyl acetate and polyisobutylene.

Other objects and advantages of the present invention will in part be obvious and will in part appear hereinafter. The invention accordingly comprises, but is not limited to, the PBX compositions and the related products and methods using those PBX compositions as exemplified by the following description and examples. Various modifications of the chemical compositions described herein, including the addition of minor amounts of additional ingredients which do not materially affect the basic and novel characteristics of the PBX compositions of this invention, and alternative products and methods using those compositions will be apparent to those skilled in the art, and all such modifications and variations are considered within the scope of this invention.

SUMMARY OF THE INVENTION

The present invention is generally directed to new and surprisingly more effective PBX compositions based on using a type of nitramine known as CL-20 as the oxidizer. It has now been found that PBX compositions utilizing CL-20 as the oxidizer, and particularly when the CL-20 is blended with particular combinations of binders and/or plasticizers, results in synergistic chemical combinations which demonstrate higher energy density and increased penetration power and impetus in military weapons applications. Preferred PBX compositions in accordance with the present invention consist essentially of CL-20 as the oxidizer, TA (triacetin) as an inert plasticizer or BDNPF, which is bis (2,2-dinitropropyl) fumarate, as an energetic plasticizer, and a binder selected from the group consisting of ethylene vinyl acetate and polyisobutylene.

DETAILED DESCRIPTION OF PREFERRED EMBODIMENTS

New and more effective plastic bonded explosive (PBX) compositions are prepared in accordance with the present invention based on the use of an energetic nitramine compound known as hexanitrohexaazaisowurtzitane, and generally identified in the literature as CL-20, as the oxidizer. CL-20 was developed by China Lake Chemical Co. in the early 1990s, and is currently manufactured in small, experimental quantities by Thiokol Corp. Descriptions of the chemical structure, preparation and current uses for CL-20 appear in U.S. Pat. No. 5,693,794 titled "Caged Polynitramine Compound" and in No. 5,712,511 titled "Preparation of Fine Particulate CL-20," both of which are incorporated herein by reference. In general, preferred PBX compositions in accordance with the present invention consist essentially of about 80–98 wt. % CL-20 as the oxidizer blended with about 1–12 wt. % of a suitable binder and with about 1–12 wt. % of a suitable plasticizer. CL-20 based PBX compositions in accordance with the present invention also include compositions containing about 80–98 wt. % CL-20 blended with about 2–20% of a suitable binder without a plasticizer. For these PBX compositions, either the binder selected will have a lower-temperature softening point, or more heat will be required to process (press) the explosive charge, or both.

U.S. government standards for explosive compositions for weapons systems require low vulnerability for safety in storage and transport and for preserving performance and integrity over extended periods of time. The novel PBX compositions of the present invention meet or exceed these standards.

In one preferred embodiment of the present invention, the PBX compositions consist essentially of about 85–98 wt. % CL-20 as the oxidizer, blended with about 1–12 wt. % of a binder selected from the group consisting of ethylene vinyl acetate (EVA) and polyisobutylene (PIB), and with about 1–12 wt. % of a suitable plasticizer. In another preferred embodiment of the present invention, the PBX compositions consist essentially of about 85–98 wt. % CL-20 as the oxidizer, blended with about 1–12 wt. % of triacetin (TA) as the plasticizer, and with about 1–12 wt. % of a suitable binder. In a particularly preferred embodiment of the present invention, the PBX compositions consist essentially of about 85–98 wt. % CL-20 as the oxidizer, blended with about 1–12 wt. % of a binder selected from the group consisting of ethylene vinyl acetate and polyisobutylene, and with about 1–12 wt. % of triacetin as the plasticizer.

CL-20 is an energetic nitramine oxidizer which is chemically related to HMX and RDX. CL-20, however, has now been determined to demonstrate several physical and chemical properties different from HMX and RDX which make it a significantly more effective oxidizer in PBX compositions. In addition, it has been found that CL-20 may function synergistically when blended with particular binder and plasticizer components. In particular, CL-20 has been found to have a significantly higher density, heat of formation, and energy compared with HMX and RDX, as illustrated in Table I below.

TABLE I

Comparison of Physical/Chemical Characteristics of Selected Oxidizers

| Energetic Oxidizer | Density (g/cc) | Heat of Formation (Kcal/mole) | Specific Energy (KJ/cm$^3$) | Gurney Velocity (Km/sec) |
|---|---|---|---|---|
| RDX | 1.82 | 14.7 | 7.72 | 2.92 |
| HMX | 1.90 | 17.9 | 8.43 | 2.97 |
| CL-20 | 2.04 | 98.0 | 9.87 | 3.11 |

At the same time, CL-20 demonstrates material safety, hazard, and processing characteristics which are generally similar to HMX and RDX, as illustrated in Table II below.

TABLE II

Comparison of Safety Characteristics of Selected Oxidizers

| Material | Thiokol Impact (in) | Thiokol Friction (lb) | Thiokol ESD (J) |
|---|---|---|---|
| HMX 3.2$\mu$ | 30 | >64 | 0.20 |
| HMX 15$\mu$ | 29 | 63 | 0.24 |
| HMX 57$\mu$ | 27 | 62 | 0.30 |
| $\alpha$-CL-20 | 23 | 62 | 0.88 |
| $\beta$-CL-20 (30$\mu$) | 20 | >64 | 0.39 |
| $\epsilon$-CL-20 (35$\mu$) | 36 | 56 | 0.36 |
| $\alpha$-CL-20 (wet) | >46 | >64 | >8 |
| $\beta$-CL-20 (wet) | >46 | 63 | >8 |
| $\epsilon$-CL-20 (wet) | >46 | >64 | >8 |

CL-20 exists as a caged, 3-dimensional structure. It exists in several polymorphs, each having a different density: $\alpha$-CL-20, $\beta$-CL-20, and $\epsilon$-CL-20. The most favorable CL-20 polymorph for PBX applications has been found to be the epsilon polymorph $\epsilon$-CL-20, which shows a 7.4% higher density than HMX, significantly higher heat of formation than HMX, and similar safety and hazard characteristics to HMX. The CL-20 chemical structure is illustrated in FIG. I below.

FIG. I

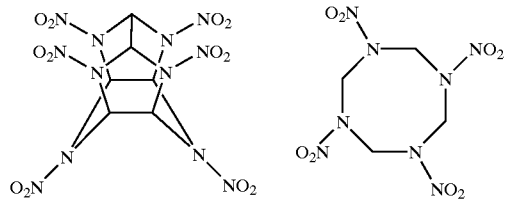

Although PBX compositions contain predominant amounts of the oxidizer component, it is not just the properties of the oxidizer that determine the performance and handling characteristics of the blended PBX compositions. One important factor in determining the performance of a PBX composition is the theoretical maximum density or TMD (identified by the Greek letter ρ) of the composition. Theoretical density is a measure of how intimately the components of a blended mixture can be mixed and how tightly the mixture can be compacted. TMD is the theoretical number obtained from theoretical calculations using thermochemical simulation programs. The actual measured value of the composition density is always lower than, but may closely approach, the TMD. The ratio of actual measured density to TMD (×100) is the "% of TMD" as referred to hereinafter.

With modern mixing techniques and equipment, the actual density of a PBX composition can approach 98–99% or better of the composition's theoretical density, but of course it can never exceed theoretical density. Increased actual density of a PBX composition is highly desirable because even small increases in composition density significantly increase the explosive "punch"—specifically, higher velocity of detonation (VOD) and increased penetration performance, as described in more detail hereinafter. Therefore, it is considered highly desirable to formulate new PBX compositions which have higher theoretical densities than conventional PBX compositions thereby yielding compositions which also have higher actual densities and which demonstrate associated superior explosive performance.

Theoretical density of a blended composition, however, is determined at least in part by the respective sizes and shapes of the molecules of the different chemical compounds which comprise the composition and the relative proportions in which the several ingredients are present. Accordingly, predicting in advance the theoretical densities of different blends of components is neither easy nor exact. In part, the novelty of the present invention resides not just in the use of CL-20 as an oxidizer in new PBX compositions, but also in the discovery that certain CL-20 polymorphs and certain binders and plasticizers function synergistically in combination with CL-20, either separately or, more preferably, together to yield new PBX compositions with higher theoretical densities than those of conventional PBX compositions, as illustrated in Table III below:

TABLE III

Comparison of Theoretical Densities for Selected PBX Formulations

| Formulation | Oxidizer | Binder | Plasticizer | ρ (gm./cc.) |
|---|---|---|---|---|
| HMX #1 | 95% HMX | 2% EVA | 3% TA | 1.8288 |
| CL-20 #1 | 95% CL-20 | 2% EVA | 3% TA | 1.9513 |
| HMX #2 | 95% HMX | 2% PIB | 3% TA | 1.8224 |
| CL-20 #2 | 95% CL-20 | 2% PIB | 3% TA | 1.9481 |
| HMX #3 | 96% HMX | 1% Hycar 2121-X66 | 3% dioctyl adipate | 1.8285 |
| CL-20 #3 | 95% CL-20 | 2% Hycar 2121-X66 | 3% TA | 1.9605 |

Table III shows that the CL-20 #1 formula in accordance with the present invention has a 6.7% higher theoretical density than the most comparable HMX #1 formula. The CL-20 #2 formula has a 6.5% higher theoretical density than the HMX #1 formula, and the CL-20 #3 formula has a 7.2% higher theoretical density than the HMX #1 formula. Table III also shows that the CL-20 #2 formula in accordance with the present invention has a 6.9% higher theoretical density than the most comparable HMX #2 formula. The CL-20 #1 formula has a 6.7% higher theoretical density than the HMX #1 formula, and the CL-20 #3 formula has a 7.6% higher theoretical density than the HMX #2 formula. Table III further shows that the CL-20 #3 formula in accordance with the present invention has a 7.2% higher theoretical density than the comparable HMX #3 formula. The CL-20 #1 formula has a 6.7% higher theoretical density than the HMX #3 formula, and the CL-20 #2 formula has a 6.5% higher theoretical density than the HMX #3 formula.

In testing, it has been found that some other CL-20/binder formulations which are in accordance with the present invention demonstrate even higher theoretical densities and higher ballistic potentials than the CL-20 #1, #2, and #3 formulations used for Table III above. For example, it has been found that a mixture of CL-20 blended with polyglacidyl nitride (PGN) as binder shows a theoretical density of 2.0019 and a ballistic potential of 1699161, which means that this mixture has the potential to be a highly effective PBX formulation. CL-20/PGN formulations would not generally be manufactured as explosives for warheads, however, because they are relatively sensitive to handling and shock. The more preferred CL-20 based PBX formulations in accordance with this invention combine high performance characteristics with relative insensitivity and good material handling properties.

Table IV below demonstrates the dramatic improvement in explosive performance, as measured by increased ballistic potential, that results from even small percentage increases in PBX composition densities.

TABLE IV

Comparison of Ballistic Potential for Selected PBX Formulations

| Formulation | ρ (gm./cc.) | Ballistic Potential | % Increase |
|---|---|---|---|
| HMX #1 | 1.8288 | 1477226 | — |
| CL-20 #1 | 1.9513 | 1617886 | 9.5% |
| HMX #2 | 1.8224 | 1436857 | — |
| CL-20 #2 | 1.9481 | 1622163 | 12.9% |
| HMX #3 | 1.8285 | 1494889 | — |
| CL-20 #3 | 1.9605 | 1626773 | 8.8% |

Table IV above shows that a 6–7% increase in the theoretical density of a PBX composition (see Table III) is associated with an increase in the ballistic potential of the PBX composition of about 8.8–12.9% relative to a comparable HMX-based PBX composition.

Example I below illustrates the preparation of a PBX composition using CL-20 in accordance with the present invention.

EXAMPLE 1

This example illustrates the preparation of a PBX composition according to this invention using 95 wt. % CL-20, 2 wt. % polyisobutylene (PIB) and 3 wt. % triacetin (TA). Comparable preparation steps and process parameters can be used for preparing other PBX compositions in accordance with this invention. Polyisobutylene (PIB) was cut into small pieces using a band saw or a knife. The PIB was then added to the Sigma Blade Mixer, which was jacketed and maintained at 140° F. The PIB was mixed until it was soft and pliable inside the mixer. CL-20 was then added in three increments based on particle size of each increment. The first increment (having 50% cumulative volume of 11.5 microns for particle size) was added to the mixer along with the triacetin (TA). Mixing was carried out for 30 minutes at 140° F. The mixer was then stopped, and the second increment of CL-20 (having a 50% cumulative volume of 9 microns for particle size) was added to the mixer. Mixing was resumed for another 30 minutes at 140° F. The third increment of CL-20 (having a 50% cumulative volume of 7 microns for particle size) was added to the mixer. Mixing was resumed for an additional 30–60 minutes at 140° F. or until the mix was consistent and homogeneous. Mixing was conducted without the use of any solvents. The only solvent utilized here was water contained in the CL-20.

The blended PBX composition was then transferred to an oven for a conditioning step, which is typically carried out at a conditioning temperature of about 140–160° F. for a minimum of 4 hours or until the powder mix temperature is at the minimum desired temperature of about 140° F. Powder pressing was then performed at a pressure range of about 35–45 KPSI, with a dwell time of about 80 seconds. Prior to pressing, the powder mix was conditioned inside the press for about 5 minutes at a temperature of 155±5° F. The pressed pellets were then placed in an oven at 140° F. to ensure that dimensional stability was achieved. During pressing, at least about 30 in. of Hg vacuum should be maintained to ensure the elimination of any air pockets in the pressed pellets.

EXAMPLE 2

This example compares certain physical, chemical and performance characteristics of a CL-20 based PBX composition in accordance with the present invention with three conventional PBX compositions, identified as PBXN-108, PBXN-107, and PBXN-110. PBXN-107, PBXN-110, and PBXN-108 are Navy formulations which contain HMX, as the major nitramine oxidizer, and a binder which is an estane polymer. The estane polymer is generally comparable to PIB and EVA polymers. The 80/20 ratio of CL-20/binder was selected as a comparison formulation. In general, a ratio of CL-20/binder of 80 wt. %/20 wt. % respectively might be used in a propellant formulation but typically not in an explosive formulation. The ratio for this example, however, was selected to offer a reasonable comparison to the several PBXN formulas. All tests were performed by Thiokol in laboratory scale testing, and published in Thiokol Corporation PBX literature. The PBX composition in accordance with the present invention consisted of a blend of 80 wt. % of CL-20 as the oxidizer with 20 wt. % of estane polymer as the binder. Performance calculations for the PBXN-108, PBXN-107 and PBXN-110 formulations were computed, and the results are shown in Table V below.

TABLE V

Performance Calculations for Selected PBX Formulations

| Explosive | Density (g/cc) | Gurney Velocity (mm/μsec) | Specific Energy (KJ/cc) |
|---|---|---|---|
| PBXN-108 | 1.57 | 2.53 | 5.01 |
| PBXN-107 | 1.64 | 2.62 | 5.62 |
| PBXN-110 | 1.68 | 2.68 | 6.04 |
| CL-20/Binder (80/20) (present invention) | 1.88 | 2.91 | 7.98 |

Results were also measured for the PBXN-108, PBXN-107 and PBXN-110 formulations, and those results were found to agree well with the performance calculations shown in Table V. Additionally, performance was calculated for the CL-20-based PBX composition, and those results are also shown in Table V for comparison. Calculated performance for the PBX composition containing CL-20 as the oxidizer was found to show a 32% higher specific energy than the PBXN-110 composition in castable explosive formulations, a 42% higher specific energy than the PBXN-107 composition, and a 59% higher specific energy than the PBXN-108 composition. Although the CL-20 containing formulation was determined to have better PBX performance characteristics, it was also found to have a lower handling sensitivity than any of the other PBX compositions.

Table VI below compares the safety characteristics of different high performance explosive formulations—an HMX/estane polymer PBX composition (such as PBXN-108, PBXN-107, or PBXN-110) and three CL-20/estane polymer PBX compositions for comparison purposes. The data of Table VI are based on actual laboratory measurements.

TABLE VI

Safety Characteristics for Selected High Performance PBX Formulations

| Composition | Impact Sensitivity (in) | Friction Sensitivity (lb) | ESD Sensitivity (J) |
|---|---|---|---|
| HMX/estane (85/15) | 29.0 | 63 | 0.24 |
| CL-20/estane (85/15) | 29.8 | >64 | >8 |
| CL-20/estane (90/10) | 39.9 | 63 | >8 |
| CL-20/estane (95/5) | 43.4 | 62 | >8 |

Impact Sensitivity Test

The impact sensitivity test was carried out in accordance with U.S. Air Force laboratory test standard MIL-STD-1751 (USAF), Method 2. In this test of explosive composition sensitivity, a drop weight is elevated to a preselected height above a test sample (explosive on sandpaper) placed in the center of an anvil, the weight is dropped, and the result ("fire" or "no-fire") is determined using a noisemeter. If the test is a "no-fire," the drop weight height is increased in steps until the test sample "fires." Accordingly, a higher drop weight height required to cause a "fire" reflects a reduced (improved) sensitivity of an explosive composition compared with one that "fires" at a lower drop weight height. Table VI above shows that each of the three CL-20-based PBX formulations required a higher drop weight height (measured in inches) to cause a "fire" than a comparable HMX-based PBX formulation.

Friction Sensitivity Test

The friction sensitivity test was carried out in accordance with U.S. Air Force laboratory test standard MIL-STD-1751 (USAF), Method 6. In this test of friction sensitivity based on initiation-of-combustion data, a test sample is placed on a movable sliding block, pressure is applied to the sample by a stationary wheel (having a machined steel or other suitable test surface) attached to a hydraulic ram, and a weighted pendulum is dropped from a pre-determined height so as to strike the block with sufficient energy to cause the block to slide in a direction perpendicular to the force applied to the sample. If the test sample does not ignite, the pressure (measured in lbs.) applied to the sample by the wheel is increased incrementally until combustion results from sliding the block. Table VI above shows that the friction sensitivity of each of the three CL-20-based PBX formulations (in terms of lbs. pressure required to cause initiation of combustion) is closely comparable to that of the HMX-based reference PBX formulation.

Electrostatic Sensitivity Test

The electrostatic sensitivity (ESD) test was carried out in accordance with U.S. Air Force laboratory test standard MIL-STD-1751 (USAF), Method 4. The electrostatic sensitivity test is used to assess the electrostatic hazards associated with the processing and handling of explosives. In this test, the sensitivity level reported is the highest energy level (measured in joules—J) at which no reaction occurred in 25 trials. The reference standard is an energy level of 0.020 J, which is the charge energy that an ungrounded person can accumulate, and which is about five times the maximum energy that an ungrounded person could discharge.

Primary explosive compositions which are ignited in this test at the 0.02 J level are considered relatively sensitive. An explosive is reported to have passed the electrostatic sensitivity test and to be acceptable as a booster or main-charge explosive if there are no reactions in the 25 consecutive trials at the 0.02 J level. Table VI above shows that the electrostatic sensitivity of the reference HMX-based PBX formulation meets the test standard by a factor of more than an order of magnitude. Test results for the three comparison CL-20-based PBX formulations, however, show still another order of magnitude improvement over the HMX-based formulation. This represents a dramatic and unexpected improvement in electrostatic sensitivity.

Thus, Table VI above shows that a formula containing a blend of CL-20 and a binder (such as estane polymer, PIB, EVA, or any TPE) is less sensitive to impact, friction and electrostatic discharge when compared with a comparable HMX-based formula. Furthermore, Table VI shows that an increase in % nitramine oxidizer relative to binder in the formulas according to the present invention results in reduced impact sensitivity, but has no negative effect on friction or electrostatic sensitivity.

Another useful comparison to demonstrate the safety and material handling characteristics of CL-20-based PBX compositions compared with conventional explosive compositions is the shock sensitivity data presented in Table VII below. Table VII compares the shock sensitivity of a CL-20-based pressed explosive with an HMX-based PBX explosive and with pressed TNT using the NSWC IHE Gap test.

TABLE VII

Shock Sensitivity of Selected Pressed Explosive Formulations

| Composition | % Energetic Material | Card Gap (in) | Pressure (kBar) | % of TMD |
|---|---|---|---|---|
| CL-20/estane | 93 | +2.25/−2.31 | 15.3 | 97.2 |
| HMX/estane | 93 | +2.16/−2.19 | 17.5 | 96.0 |
| Pressed TNT | 100 | +1.91/−1.93 | 23.8 | 93.2 |

Table VII above shows that the CL-20/estane formulation is less sensitive to shock than TNT charges or HMX/estane formulations, even though it has the highest percentage of theoretical maximum density (TMD). This is because the pressure generated by a CL-20/binder formula, as a result of a shock initiation, is lower than that for either HMX/binder or TNT.

EXAMPLE 3

This example demonstrates the improvement in the velocity of detonation (VOD or Vd) realized by using CL-20-based PBX compositions in accordance with this invention compared with an HMX-based PBX formulation identified as PBXW-11, a blend of HMX nitramine oxidizer and Hi-Temp binder, based on calculated performance as confirmed by agreement with actual measured performance. VOD can be calculated from the equation:

$$Vd=2.9847+3.1188\rho$$

where ρ represents the theoretical maximum density of the PBX composition. For the PBXW-11 formulation, Vd was calculated to be 8687 meters/second, which was comparable to the actual measured VOD of 8820 m/s. Table VIII below compares the calculated VOD of the PBXW-11 formulation with that of three CL-20-based formulations, including one (CL-20 #3 Formulation) which is substantially identical to the PBXW-11 formulation except for the use of CL-20 as the oxidizer instead of HMX and the use of triacetin as the plasticizer instead of dioctyl adipate.

TABLE VIII

VOD Comparison For Selected PBX Formulations

| Formulation | Oxidizer | Binder | Plasticizer | VOD (m/s) |
|---|---|---|---|---|
| PBXW-11 | 96% HMX | 1% Hycar 2121-X66 | 3% Dioctyl Adipate | 8687 |
| #1 | 95% CL-20 | 2% EVA | 3% TA | 9070 |
| #2 | 95% CL-20 | 2% PIB | 3% TA | 9060 |
| #3 | 95% CL-20 | 2% Hycar 2121-X66 | 3% TA | 9100 |

Table VIII shows that the VOD of the CL-20 #1 Formulation was 383 m/s higher than the calculated VOD of the PBXW-11 formulation; the calculated VOD of CL-20 #2 Formulation was 370 m/s higher; and the calculated VOD of the CL-20 #3 Formulation was 413 m/s higher.

EXAMPLE 4

This example demonstrates the improvement in the penetration performance realized by using CL-20/binder PBX compositions in accordance with this invention compared with a comparable HMX-based PBX formulation using the same binder and same 95 wt. %/5 wt. % oxidizer/binder ratio.

For this example, one shell was packed with the HMX-based PBX formulation and discharged into a stack of identical target bricks made of concrete. This first shell penetrated through five target bricks and into the sixth. A second shell, identical to the first, was packed with the comparable CL-20-based PBX formulation and discharged into a stack of target bricks identical to those used for the HMX-packed shell. This second (CL-20-packed) shell penetrated through seven target bricks and into the eighth, thereby showing a significant 40%+ increase in penetration performance.

Accordingly, PBX compositions based on CL-20 as the energetic oxidizer demonstrate surprisingly superior performance compared with comparable HMX-based PBX formulations while maintaining similar or better safety and material handling characteristics.

It will be apparent to those skilled in the art that other changes and modifications may be made in the above-described CL-20-based PBX compositions, and in the applications for such improved PBX compositions, without departing from the scope of the invention herein, and it is intended that all matter contained in the above description shall be interpreted in an illustrative and not a limiting sense.

Having described the invention, what I claim is:

1. A high performance CL-20-based plastic bonded explosive (PBX) composition consisting essentially of about 80–98 wt. % CL-20 oxidizer, about 1–12 wt. % of polyisobutylene as a binder, and about 1–12 wt. % of triacetin as a plasticizer, wherein said PBX composition has enhanced theoretical density, ballistic potential, and penetration performance compared with a substantially identical HMX-based PBX composition.

2. A CL-20-based PBX composition according to claim 1 wherein said CL-20-based PBX composition has a theoretical density that is about 6.9% higher than the theoretical density of a substantially identical HMX-based PBX composition.

3. A CL-20-based PBX composition according to claim 1 wherein said CL-20-based PBX composition has a ballistic potential that is about 12.9% greater than the ballistic potential of a substantially identical HMX-based PBX composition.

4. A CL-20-based PBX composition according to claim 1 wherein said CL-20-based PBX composition has a penetration performance that is about 40% greater than the penetration performance of a substantially identical HMX-based PBX composition.

5. A high performance CL-20-based plastic bonded explosive (PBX) composition consisting essentially of about 95 wt. % CL-20 oxidizer, about 2 wt. % polyisobutylene as a binder, and about 3 wt. % of triacetin as a plasticizer.

6. A composition according to any of claims 1–5 wherein said CL-20 oxidizer is selected from the group consisting of α-CL-20 polymorph, β-CL-20 polymorph, ϵ-CL-20 polymorph, and mixtures thereof.

7. A composition according to claim 6 wherein said CL-20 oxidizer consists essentially of ϵ-CL-20.

8. A composition according to any of claims 1–5 wherein the actual density of said composition is 98% or higher of the theoretical density of said composition.

9. A composition according to any of claims 1–5 wherein the actual density of said composition is 99% or higher of the theoretical density of said composition.

10. A composition according to any of claims 1–5 wherein said composition is packed into a shell.

11. A composition according to any of claims 1–5 wherein said composition consists essentially of ϵ-CL-20 polymorph, polyisobutylene, and triacetin.

* * * * *